US005378513A

United States Patent [19]

Lee

[11] Patent Number: 5,378,513

[45] Date of Patent: Jan. 3, 1995

[54] CLEPSYDRA DECORATION SET

[76] Inventor: Vincent K. W. Lee, No. 44, Lane 458, Sheh Chung St., Taipei, Taiwan, Prov. of China

[21] Appl. No.: 45,115

[22] Filed: Apr. 12, 1993

Related U.S. Application Data

[63] Continuation-in-part of Ser. No. 929,135, Aug. 13, 1992, Pat. No. 5,255,460.

[51] Int. Cl.[6] ..... G09F 19/00

[52] U.S. Cl. ..... 428/13; 40/409

[58] Field of Search ..... 428/13, 14, 12; 40/409

[56] References Cited

U.S. PATENT DOCUMENTS

| | | | |
|---|---|---|---|
| 690,852 | 1/1902 | Gordon | 40/409 |
| 1,627,270 | 5/1927 | Burnham | 40/409 |
| 3,819,436 | 6/1974 | Allen | 428/13 X |
| 4,031,643 | 6/1974 | Templeton | 428/13 X |
| 4,081,666 | 3/1978 | Roehrick | 428/13 X |
| 4,885,192 | 12/1989 | Tabar | 428/13 |
| 4,944,969 | 7/1990 | Usui | 428/14 |
| 5,092,064 | 3/1992 | Lee | 40/406 |
| 5,255,460 | 10/1993 | Lee | 40/409 |

*Primary Examiner*—Henry F. Epstein
*Attorney, Agent, or Firm*—Bacon & Thomas

[57] ABSTRACT

A decoration set includes a transparent container having upper and lower terminal portions interconnected to by a slanting middle part. Each of the terminal portions defines a reservoir adapted to carry a sandy medium stored within the container. A board is mounted within the container and includes opposing sides provided with rippled surfaces which cause a decorative pattern as the sandy medium flows thereover. The container can be oriented in a first upright position wherein the sandy medium flows over the rippled surface causing a pattern on one side of the board and an inverted, upright position wherein the sandy medium flows over the rippled surface causing a pattern on the other side of the board. The side surfaces also include vents through which the sandy medium flows.

2 Claims, 6 Drawing Sheets

CLEPSYDRA DECORATION SET

CROSS-REFERENCES TO RELATED APPLICATIONS

This is a continuation-in-part application of Ser. No. 07/929,135 filed Aug. 13, 1992 now U.S. Pat. No. 5,255,460.

BACKGROUND OF THE INVENTION

Most clepsydra decoration sets in the market need to be shaken to demonstrate their dynamic changes of view inside. Since these changes will finish shortly after the shake, such sets are not desirable to most customers.

SUMMARY OF THE INVENTION

The clepsydra decoration set of the present invention includes an oblique board installed inside a transparent container having a ripple surface on the board so that one can produce all kinds of dynamic views such as dashing billows, beautiful landscape, a slow flowing stream, an erupting volcano, the rash of sands, etc.

DESCRIPTION OF THE PREFERRED EMBODIMENTS

Figure 1:
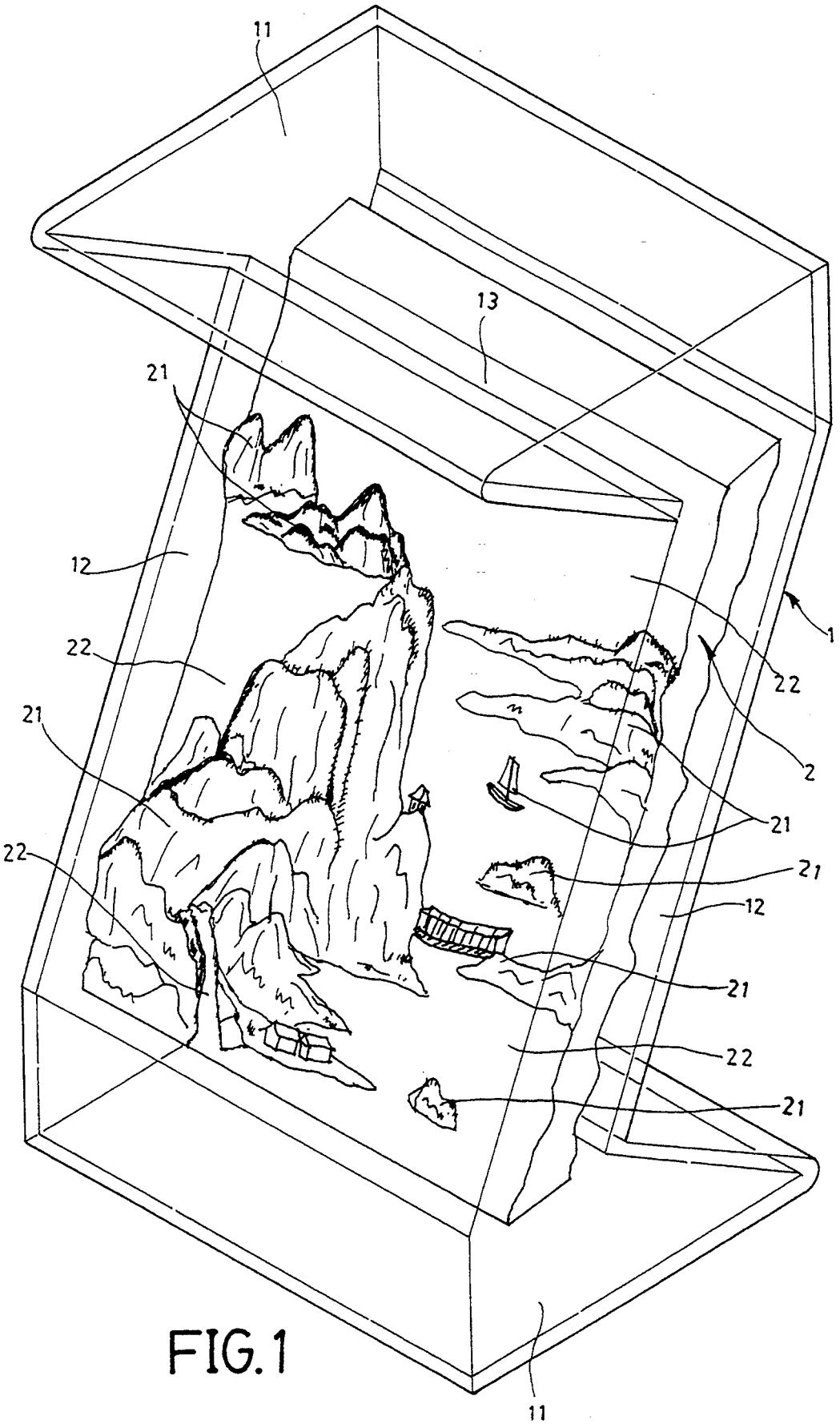
FIG. 1 is a perspective view of the invention.
Figure 2:
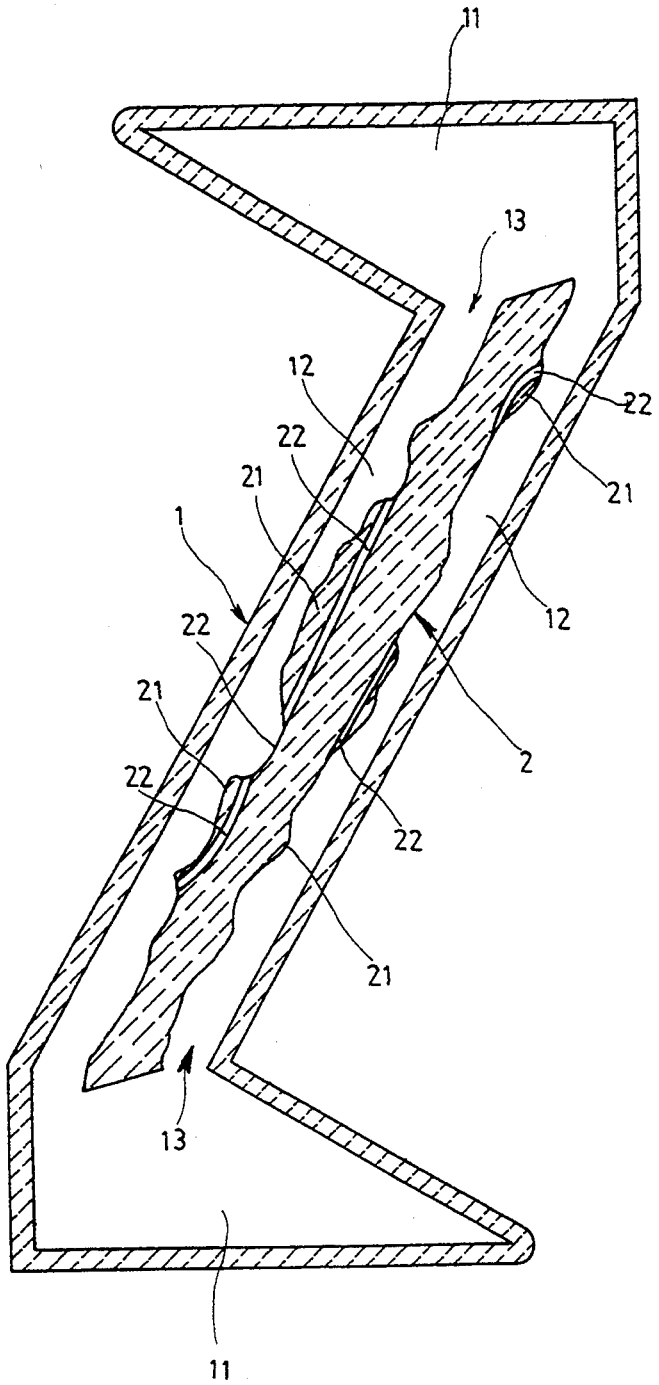
FIG. 2 is a sectional drawing of the invention.
Figure 3:
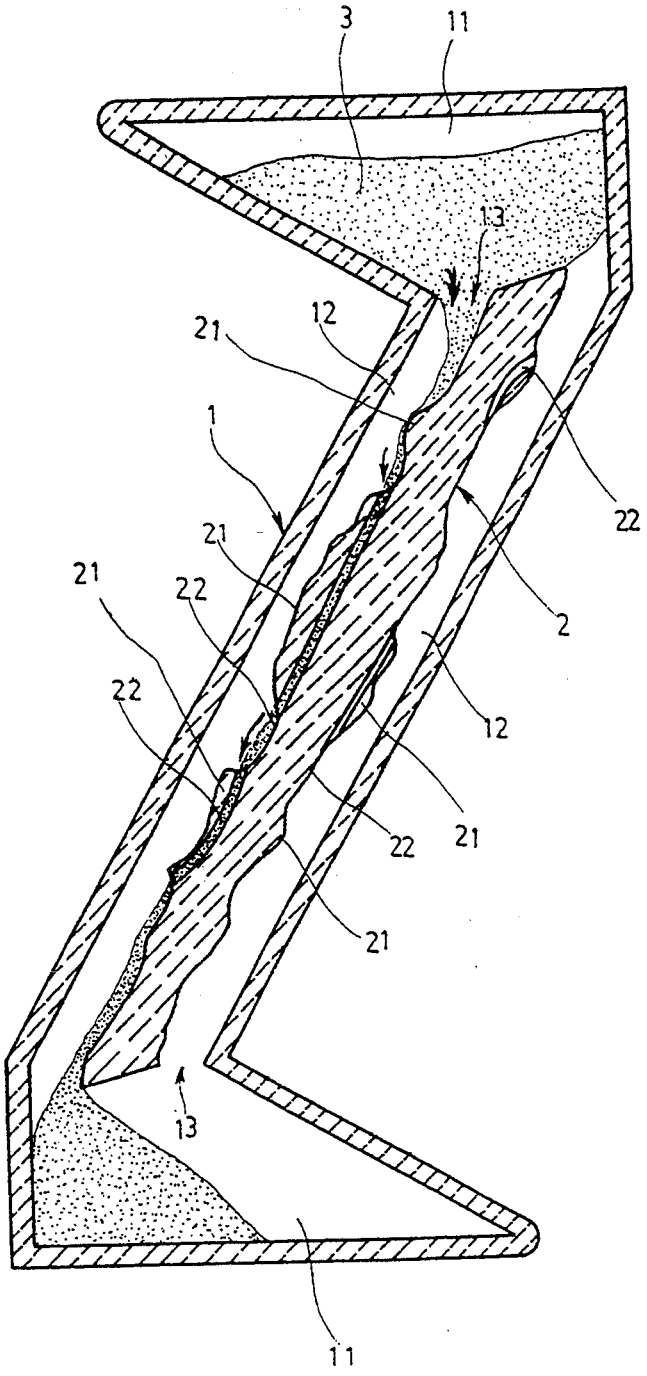
FIG. 3 is an illustration of the flowing of elements.
Figure 4:
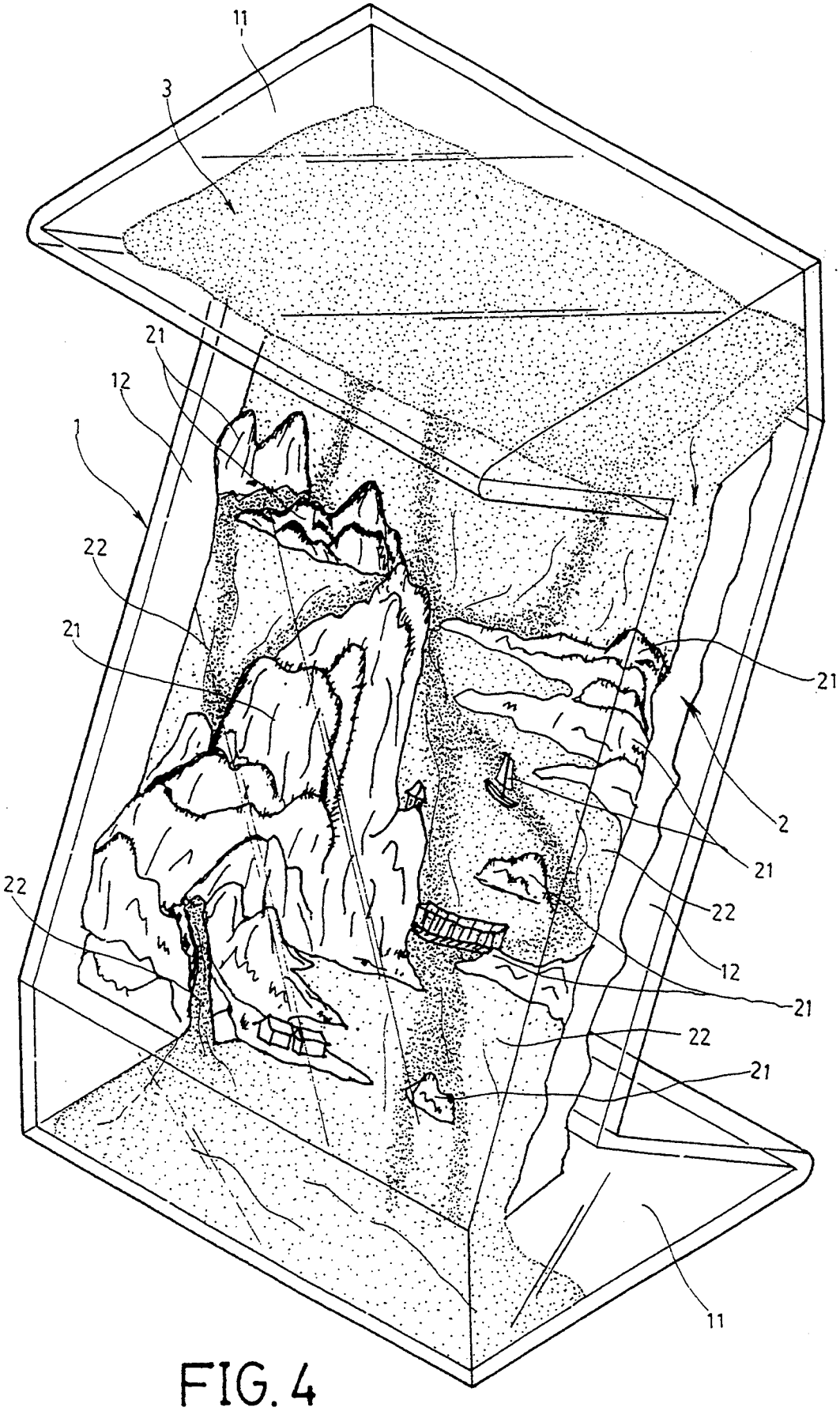
FIG. 4 is an illustration of the functioning of the invention.
Figure 5:
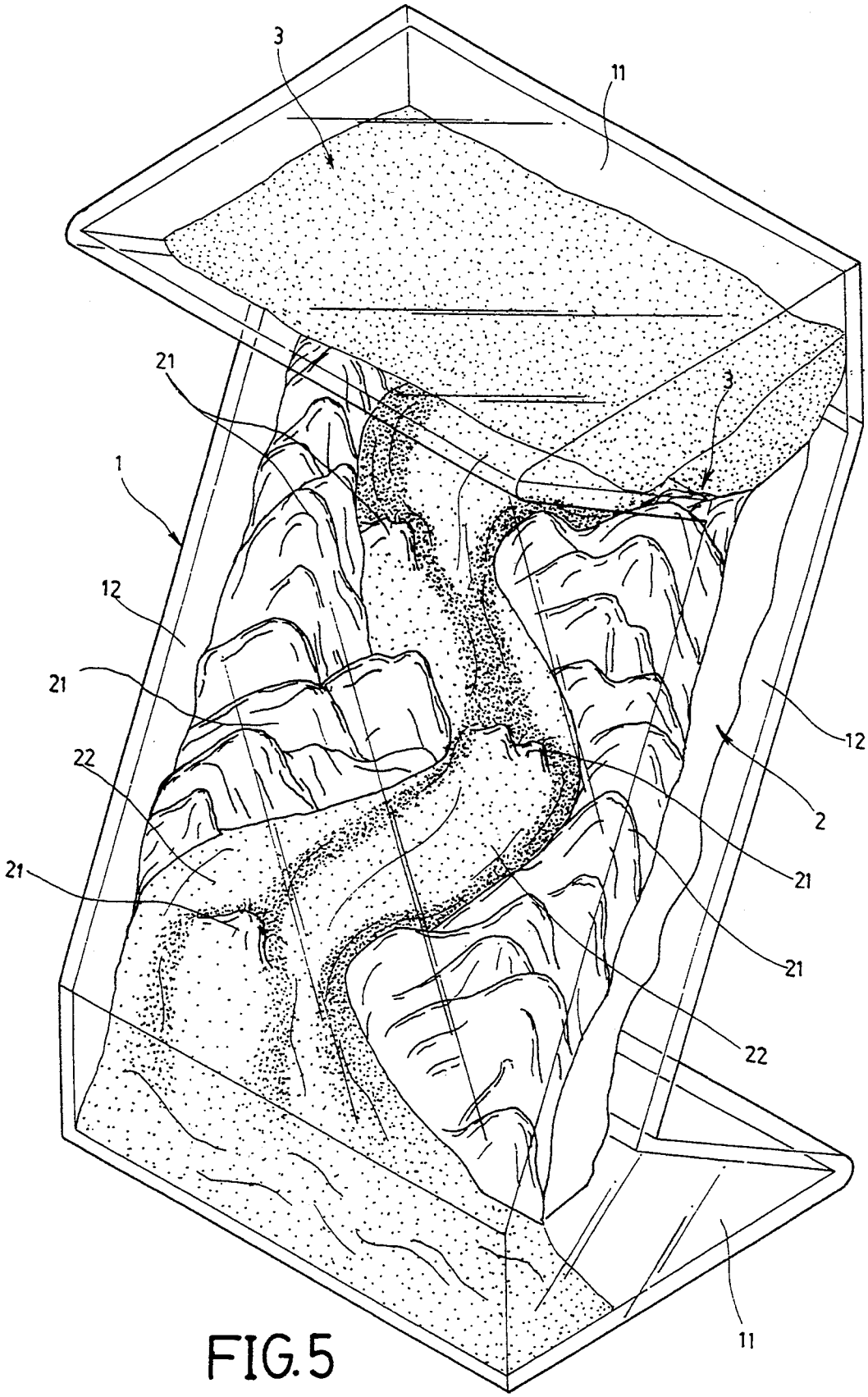
FIG. 5 is an illustration of the functioning of the invention after being reversed.

Refer to FIGS. 1 & 2, the invention is a clepsydra decoration set which comprises of a transparent container(1) of any shape and an oblique board (2) installed in the transparent container (1). The container has top and bottom sections bigger than the comparatively slim slanting middle section so that both the top and bottom sections become reservoirs(11) for the storage of a large amount of sand (3). The board(2) is designed for the slim slanting middle section of container(1) where the board(2) is installed according to its gradient so that the original slim middle section leaves but two tiny channels(12) of 2 cm located in front of and behind the board for the transportation of sand (3) from and to both reservoirs(11). When the sand (3) flows through the channels(12) alongside board(2), beautiful and dynamic views form. Both surfaces of board(2) can be injected or modified to have rough surfaces with different decorations or patterns(21) and vents(22) beneath so that when the sand (3) flows out from the reservoirs(11) via the exits(13) and arrives at the channels(12) as shown in FIG. 3, it passes through the decorations and patterns(21) on the surface of board(2) and the vents (22) beneath. The style/shape of the decorations and patterns (21), along with vents (22), on the board (2) will produce dynamic views such as dashing billows, beautiful landscape, a slow flowing stream, an erupting volcano, the rash of sands, etc. The entire structure of invention is to modify the surfaces of the board(2) after both the transparent container(1) and board(2) are finished individually, so that it becomes a board(2) whose rough surfaces contain decorations or patterns(21) with vents(22) beneath and which is installed inside the transparent container(1) so as to form the channels(12) and exits(13). After being welded ultrasonically, it is filled with fillers such as water and sand (3) and sealed as shown in FIG. 4. When sand (3) flows downward from reservoir(11) via the exit(13) and arrives at the channels(12) due to gravitational force, the flow of sand (3) within the channels(12) must be guided by the vents (22) and passes through the preset decorations or patterns(21) to produce many views as expected until the sand (3) at the top drains to the bottom, and, if one desires to enjoy the view again, reverse the decoration set and everything starts over again as shown in FIG. 5. The improvement made to the board(2) presents a unique and novel dynamic view that is never found in clepsydra decoration set.

Figure 6:
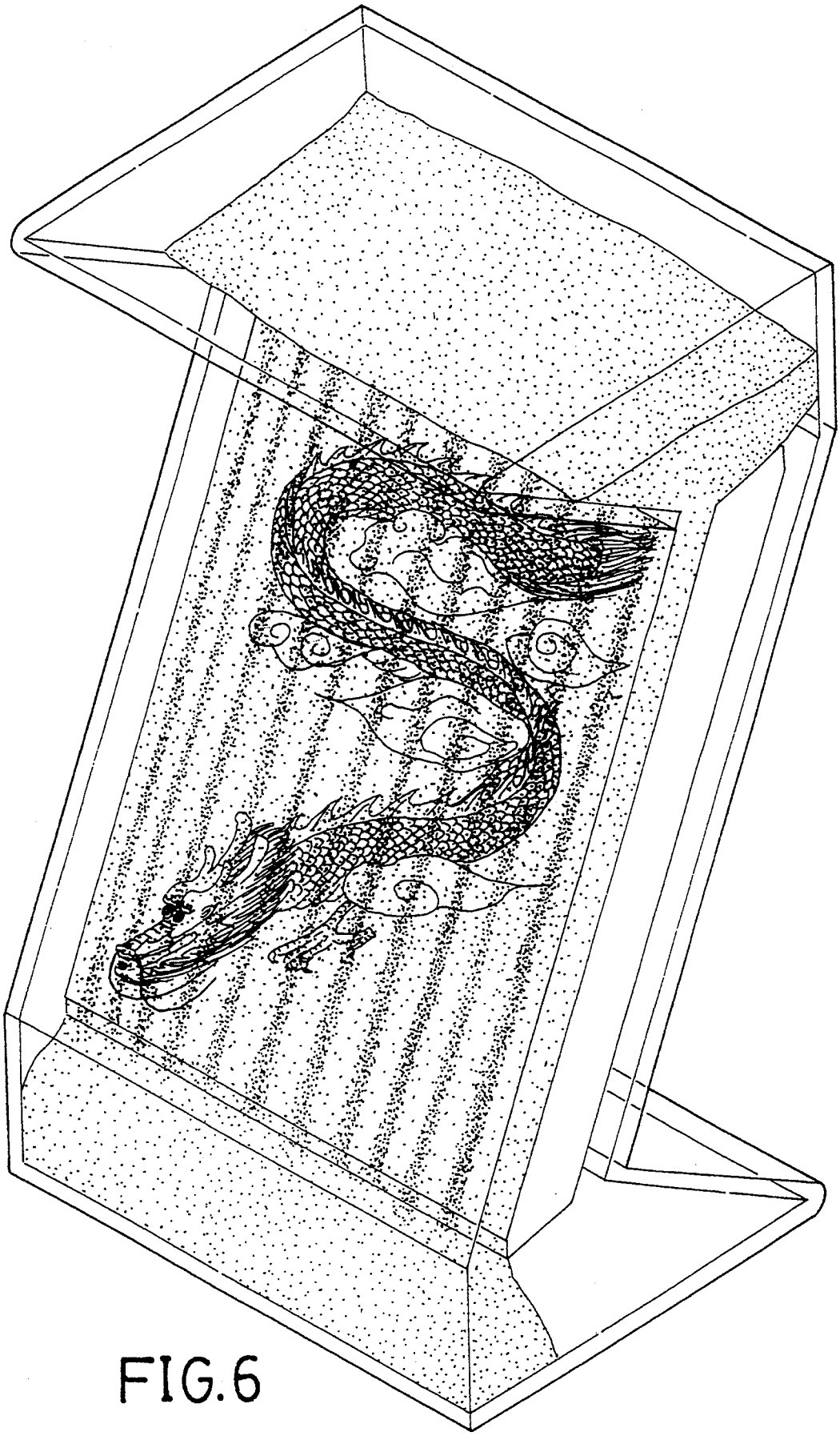
FIG. 6 is an illustration of the sand picture presented by another kind of clepsydra decoration.

Moreover, the ripple design of the board(2) inside the transparent container(1) shall be made to meet personal taste. It shall be a fiat surface with vents(22) beneath as shown in FIG. 6 so that when sand (3) flows down from the reservoir(12), the sand (3) passes through the vents(22) and produce a view of "curtain of pearl" or "curtain of dew". If it is coupled with a board(2) of wonderfully drawn picture, it will be a romantic drawing blended with the art of craftmanship and the spirit of ancestry that is rarely seen. It satisfies the spiritual need of customers, lowers the manufacture cost, and is practical.

The main purpose of the invention is to provide a kind of clepsydra decoration set with whose simple but compact improvement to lower manufacture cost and demonstrate unusual visual enjoyment which that enriches the dynamic of the conventionals and becomes more desirable.

The secondary purpose of the invention is to make use of the board inside the container to produce view that has never before been seen by modifying it to be a ripple surface on which there are decorations or patterns with vents beneath. The easy procedures of modification save labor and time, lower manufacture cost which that makes the invention more competitive.

I claim:

1. A decoration set comprising:

a transparent container having upper and lower terminal portions interconnected by a slanting middle portion, said slanting middle portion being defined by spaced, substantially parallel wall members, said terminal portions defining first and second reservoirs within said container and being adapted to support said container in a first upright position and a second upright position respectively;

a board mounted within said slanting middle portion of said container, said board having first and second opposed side surfaces that are spaced from said wall members by a predetermined distance so as to define first and second channels located between said first and second side surfaces and said wall members respectively, each of said first and second channels opening into said first and second reservoirs, each of said first and second side surfaces including ripples; and a sandy medium retained within said container, whereby said sandy medium is adapted to flow from said first reservoir, within said first channel and over said first side surface, toward the second reservoir while forming a decorative pattern as the sandy medium passes over the ripples of said first side surface and when said container is inverted from said first upright position to said second upright position, said sandy medium flows from said second reservoir, within the second channel and over the second side surface, toward said first reservoir while forming a decorative pattern as the sandy medium passes over the ripples of said second side surface.

2. The decoration set of claim 1, wherein each of said first and second side surfaces includes at least one vent extending through a predetermined portion of said board through which the sandy medium flows.

* * * * *